US007000802B2

(12) United States Patent
Kringel et al.

(10) Patent No.: US 7,000,802 B2
(45) Date of Patent: Feb. 21, 2006

(54) DISPENSING BOX

(75) Inventors: George Kringel, Westport, CT (US); Robert S. Frichette, Trumbull, CT (US); Arthur A. Rotelli, III, Fairfield, CT (US)

(73) Assignee: News America Marketing, Wilton, CT (US)

( * ) Notice: Subject to any disclaimer, the term of this patent is extended or adjusted under 35 U.S.C. 154(b) by 0 days.

(21) Appl. No.: 10/391,141

(22) Filed: Mar. 18, 2003

(65) Prior Publication Data

US 2004/0182874 A1 Sep. 23, 2004

(51) Int. Cl.
*B65H 1/00* (2006.01)

(52) U.S. Cl. ..... 221/35; 221/45; 221/52; 221/56; 221/58; 221/63

(58) Field of Classification Search ..... 221/45, 221/52, 56, 58, 63, 305, 283, 35, 34
See application file for complete search history.

(56) References Cited

U.S. PATENT DOCUMENTS

| | | | | | |
|---|---|---|---|---|---|
| 383,036 | A | * | 5/1888 | Breese | 206/39.5 |
| 601,144 | A | | 3/1898 | Howe | |
| 1,020,175 | A | | 3/1912 | Arnold | |
| 1,209,054 | A | | 12/1916 | Skall | |
| 1,678,339 | A | | 7/1928 | Horwitt | |
| 1,734,045 | A | | 11/1929 | Parran | |
| 1,739,801 | A | | 12/1929 | Pitts | |
| 1,783,414 | A | | 12/1930 | Daniels | |
| 1,796,262 | A | | 3/1931 | Gaisman | |
| 2,011,403 | A | * | 8/1935 | Gessler | 221/35 |
| 2,027,671 | A | | 1/1936 | Broeren | |
| 2,098,477 | A | | 11/1937 | Welsh | |
| 2,101,307 | A | | 12/1937 | Bodette | |
| 2,237,424 | A | | 4/1941 | Hope | |
| 2,253,742 | A | | 8/1941 | West et al. | |
| 2,256,204 | A | | 9/1941 | Jameson | |
| 2,464,426 | A | | 3/1949 | Williams | |
| 2,522,427 | A | * | 9/1950 | Borden | 221/35 |
| 2,795,353 | A | | 6/1957 | Tuttle | |
| 3,002,651 | A | * | 10/1961 | Gauld | 221/34 |
| 3,068,055 | A | | 12/1962 | Lenzi et al. | |
| 3,071,289 | A | * | 1/1963 | Taylor | 221/59 |
| 3,147,856 | A | | 9/1964 | Lightner et al. | |
| 3,381,853 | A | | 5/1968 | Ferris et al. | |
| 3,589,555 | A | | 6/1971 | Burkhalter | |
| 3,604,562 | A | | 9/1971 | Loeffler | |
| 3,724,716 | A | | 4/1973 | Baraconi et al. | |
| 3,881,649 | A | | 5/1975 | Krautsack | |
| 3,953,090 | A | | 4/1976 | Fuchs | |
| 4,130,197 | A | | 12/1978 | Fox | |
| 4,179,138 | A | | 12/1979 | Bogdanovic | |

(Continued)

FOREIGN PATENT DOCUMENTS

| | | |
|---|---|---|
| DE | 2 417 688 | 11/1974 |

(Continued)

*Primary Examiner*—David H. Bollinger
(74) *Attorney, Agent, or Firm*—Mayer, Brown, Rowe & Maw LLP

(57) ABSTRACT

A dispensing box, and more particularly a device for holding a stack of individual sheets of flexible paper (e.g., coupons, recipes, rebates) or individual product samples for in-store advertising and promotion. The dispensing box has a resilient insert which pushes the stack towards an opening in the dispenser that is constructed in such a way that individual items may be gripped and removed one at a time while the remaining stack of items is retained within the dispenser.

13 Claims, 5 Drawing Sheets

U.S. PATENT DOCUMENTS 4,382,526 A * 5/1983 Stone ..... 221/34
4,384,418 A 5/1983 Alley
4,401,233 A 8/1983 Frey
4,416,392 A 11/1983 Smith
4,562,938 A 1/1986 Loder
4,586,630 A 5/1986 Loder
4,586,631 A 5/1986 Loder
4,623,073 A 11/1986 Hansen
4,653,666 A 3/1987 Mertens
4,767,022 A * 8/1988 Oldorf ..... 221/92
4,770,320 A 9/1988 Miles et al.
4,781,306 A 11/1988 Smith
4,805,331 A 2/1989 Boggess et al.
4,842,303 A 6/1989 Molenda
4,899,886 A 2/1990 Johansen
4,907,825 A 3/1990 Miles et al.
4,951,837 A 8/1990 Lentsch
4,953,746 A * 9/1990 Andriash ..... 221/35
4,967,951 A 11/1990 Sherman
4,986,440 A 1/1991 Windorski
4,993,590 A 2/1991 Windorski
4,997,105 A 3/1991 Fischer
5,080,254 A 1/1992 Feer
5,083,765 A 1/1992 Kringel
5,086,946 A 2/1992 Blackwell et al.
5,097,981 A 3/1992 Degasperi et al.
5,127,545 A 7/1992 French
5,165,570 A 11/1992 Windorski et al.
5,299,712 A 4/1994 Carlson et al.
5,337,897 A * 8/1994 Yablans ..... 206/581
5,358,141 A 10/1994 Carlson et al.
5,363,985 A 11/1994 Cornell
5,366,776 A 11/1994 Mertens
5,390,820 A 2/1995 Wright et al.
5,401,547 A 3/1995 Blackwell et al.
5,439,721 A 8/1995 Pedroli et al.
5,470,138 A 11/1995 Kump
5,518,144 A 5/1996 Samuelson et al.
5,755,356 A 5/1998 Bastiaens et al.
5,798,159 A 8/1998 Callahan, Jr. et al.
5,848,723 A 12/1998 Krautsack
5,939,161 A 8/1999 Callahan, Jr. et al.
5,944,219 A 8/1999 Emoff et al.
5,979,699 A 11/1999 Simpson
6,010,031 A 1/2000 Fox
6,053,356 A 4/2000 Emoff et al.
6,123,221 A 9/2000 Simpson
6,267,263 B1 7/2001 Emoff et al.
6,283,295 B1 9/2001 Akutagawa et al.
6,318,589 B1 11/2001 Simpson
6,550,636 B1 * 4/2003 Simpson ..... 221/59

FOREIGN PATENT DOCUMENTS

SE 186224 11/1936
SE 593830 12/1977

* cited by examiner

DISPENSING BOX

FIELD OF INVENTION

This invention relates generally to a dispensing box, and more particularly a device for holding a stack of individual sheets of flexible paper (e.g., coupons, recipes, rebates) or individual product samples for in-store advertising and promotion.

BACKGROUND OF INVENTION

In the area of dispensing coupons and product samples, etc., stacks of loose coupons or coupon pads (or stacks of product samples) placed near the products advertised by those coupons or samples have proved inefficient in the past for several reasons. First, consumers often take more than one item and end up disposing of the extras or using more than one. This result is inconsistent with the purpose of the related marketing programs which issue these items as incentives for consumers to purchase their product. Additionally, the unprotected coupons/samples are easily torn, crumpled, or otherwise damaged, often leaving them unsuitable for use. These problems disrupt the efficiency of such advertising and marketing programs.

Present refillable dispensers whether electrically or manually operated pose different problems. While these kinds of dispensers are designed to protect the coupons/samples and dispense them one at a time, they may malfunction, may be maintenance intensive, and may be relatively expensive. Even the less expensive versions require a particular method and/or pattern of stacking and folding in order to dispense the items properly. These requirements effectively lower the cost efficiency of the related in-store advertising and marketing programs.

Accordingly, there is a need for a low cost, low maintenance method of dispensing coupons and product samples. Other needs will become apparent upon a reading of the following detailed description, taken in conjunction with the drawings.

SUMMARY OF THE INVENTION

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the present invention. Together with the description, the drawings serve to explain the principles of the invention.

One embodiment of this invention is meant to provide an inexpensive, maintenance free, dispenser that can be customized to fit a multitude of products including coupons, recipes, rebates, and product samples, and is structured to allow ready access to only one item at a time. The dispenser, when used, contains a stack of flexible paper, or product samples, used for in-store product advertising and promotion. The dispenser can stand freely on its own, or can be attached either parallel or perpendicular to shelving, displays, or objects attached to shelving or displays. It can also dispense flexible paper or product samples from one or more separate openings.

One embodiment of the present invention is disposable and allows individual sheets of flexible paper or individual product samples to be dispensed very simply. However, those with skill in the art will recognize that the present invention need not be disposable, and can be refillable. In one preferred embodiment, a resilient block is used in combination with board stock or plastic ramp to provide a spring-like effect resulting in the paper sheets or product samples being urged toward an opening in the dispenser. The resilient member and ramp structure may be any size or shape, and be oriented in any manner, allowing for the dispensers to handle a wide variety of sizes and shapes of flexible paper or sample packets. Further, the dispenser may be attached to shelving, displays, or windows in a variety of ways, including by way of cable ties or suction cups to afford an attractive, eye-catching advertising display at or near the point of purchase.

In one embodiment, a resilient insert, which may be made of foam, is wedged between a hinged piece of board stock inside the dispenser and exerts pressure on the stack of flexible paper or product samples which rest on the board stock piece, thereby urging the paper or sample toward an opening in the dispenser. The opening may be located near one end of the dispenser along a side thereof. The opening is advantageously shaped in such a way so that the two corners of the dispenser adjacent the opening remain in place and work to hold down the stack of paper or samples as the insert urges them up toward the opening. Thus when a customer slides, for example, the uppermost piece of paper out through the opening, the ends thereof will easily disengage the corners while the rest of the stack remains in place.

Similar to the coupon box, the sample box of one embodiment of the present invention, when used, contains a stack of packets containing product samples which are also used for in-store advertising and promotion. This dispenser can also be free standing or attached either parallel or perpendicular to shelving, displays, or objects attached to shelving or displays. It can also be used to dispense samples from one or more separate openings. In one embodiment, a resilient insert, which may be made of foam, is wedged behind a flexible ramp-like structure, which may be made of plastic, inside the dispenser and exerts pressure on the product samples which rest on the ramp. The dispenser also has at least one opening located along at least one side of the dispenser. The samples are positioned between the plastic ramp and the dispenser wall, which allows the samples to follow a designated path out of the opening in the dispenser when removed. The insert and ramp combination provide sufficient force on the samples to keep them secure whether there is only one sample or multiple samples in the dispenser. The opening allows one sample to be removed at a time by sliding the sample towards the larger portion of the opening in the dispenser. This sample box configuration allows the ramp to be held within the box preventing removal or disruption thereof.

BRIEF DESCRIPTION OF DRAWINGS

FIG. 14 shows a view of one end of an embodiment of the present invention, with the end flaps folded and a suction cup protruding from the end flaps.

DESCRIPTION OF THE PREFERRED EMBODIMENT

Figure 1:
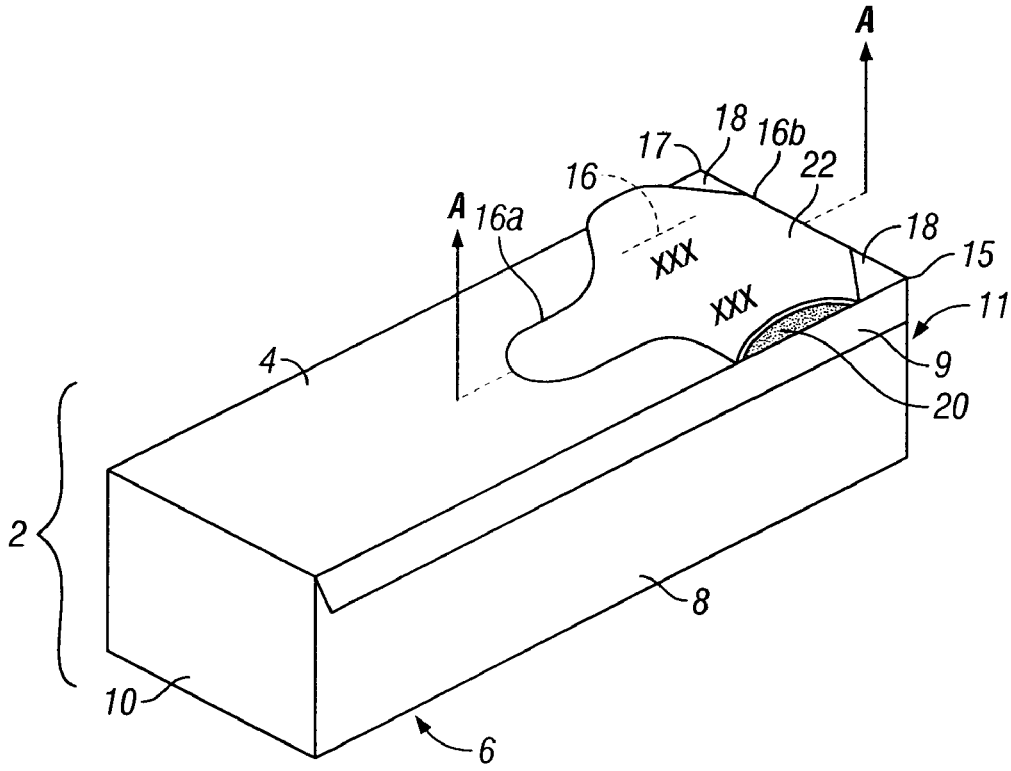
FIG. 1 is a perspective view of one preferred embodiment of the present invention that dispenses flexible paper from one side of the box.
Figure 2:
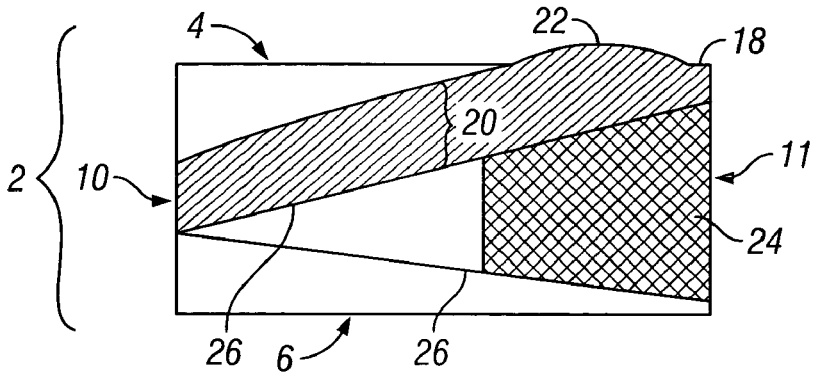
FIG. 2 is a cross-sectional view of one preferred embodiment of the present invention, taken along the line A—A of FIG. 1.
Figure 3:
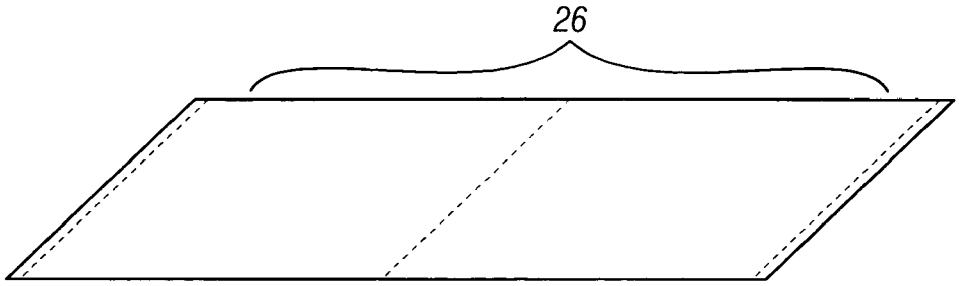
FIG. 3 is a perspective view of a hinged board stock insert, prior to being formed as a ramp useful in one embodiment of the present invention.
Figure 4:
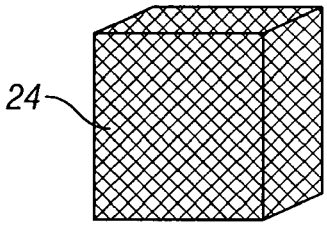
FIG. 4 is a perspective view of a resilient insert useful in one embodiment of the present invention.
Figure 5:
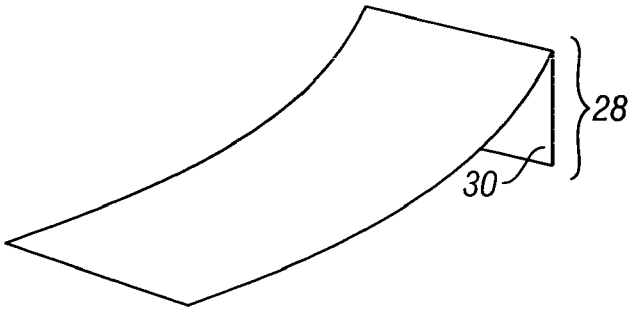
FIG. 5 is a perspective view of a ramp useful in one embodiment of the present invention.

While the present invention is capable of embodiment in various forms, there is shown in the drawings and will hereinafter be described a preferred embodiment with the understanding that the present disclosure is to be considered an exemplification of the invention, and is not intended to limit the invention to the specific embodiment illustrated. The figures are numbered by part and the same numbers are used in all the figures to identify structurally similar parts.

Referring to FIGS. 1–4, the dispenser 2 preferably comprises a rectangular-shaped box made from a single piece of board stock folded in a manner to create the dispenser 2. Methods of folding a single piece of board stock to form a box are well-known in the art. Those skilled in the art will recognize that other shapes for the dispenser 2, such as squares, circles, parallelograms, etc., are equally applicable to the present invention. The dispenser 2 has four walls (top wall 4, bottom wall 6, and side walls 5, 8) and two ends 10, 11. Each of the ends 10, 111 of the dispenser 2 comprise extensions, or end flaps 34, 35, 36, 37, and 50, 51, 52, 53 (see FIG. 6*a*), which are folded together to form the ends 10, 11 of the dispenser 2. The top wall 4 of the dispenser includes an opening 16 sufficiently large to allow a person to remove a sheet of paper 22 from the dispenser 2 with, for example one or two fingers or the thumb and a finger. The opening 16 may encompass approximately one-quarter to one-half of the top wall 4 and can be any shape that will allow for sufficient retention of the sheets of paper 20 while allowing removal of each individual piece of paper 22 by a consumer. Preferably, the opening contains a finger-shaped portion 16*a*, which transitions into a larger portion 16*b*. A retaining portion 18 of the top wall is located at each of two corners 15, 17 of the opening 16 to hold one end of the stack of flexible paper 20 within the dispenser 2. The portion 18 may be of triangular or any other shape, such as rectangular, arcuate, etc.

Preferably, a stack of individual sheets of flexible paper 20 is placed within the dispenser 2 such that about one-quarter to one-half of the top sheet 22 on the stack is able to be grasped through the opening 16 in the dispenser 2. The corners of the top sheet 22 are held down by the two shaped portions 18 of the top wall 4 at the corners 15, 17 of the opening 16. This construction advantageously allows an individual sheet of paper 22 to be removed from the dispenser 2, while still being held entirely within the dispenser 2 prior to removal. As the top sheet 22 on the stack 20 is withdrawn through the opening 16 in the dispenser 2, the next sheet in the stack is exposed for removal. However, each sheet of paper 22 is held entirely within the dispenser 2 by the portions 18 until it is withdrawn from the stack 20 by a consumer.

In order to urge the stack of paper 20 toward the opening 16 in the dispenser 2, the dispenser 2 is provided with an insert 24, preferably of a resilient foam. However, insert 24 can comprise any other resilient material or construction, such as springs (metallic, plastic, and the like), rubber, opposing magnets, or a combination thereof. The insert 24 is preferably positioned within the fold of a piece of board stock 26 or other similar material to form a spring-like mechanism. However, the insert 24 may be used without any board stock or other material, in which case, the resilient member would contain a surface that would directly contact the stack of paper or product to be dispensed. The preceding sentence applies to all embodiments described herein. When located beneath the stack of paper 20 within the dispenser 2, the resiliency of insert 24 provides a spring-like action gently urging the paper 20 towards the dispenser opening 16 for removal by the customer.

Figure 6:
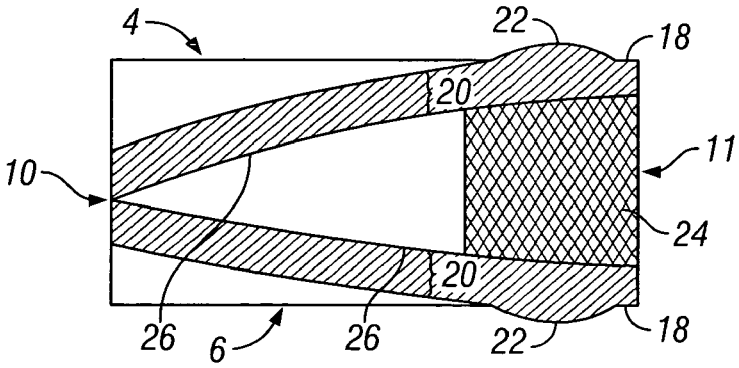
FIG. 6 is a cross sectional view, similar to FIG. 2, of an example of one embodiment of a coupon box of the present invention that dispenses flexible paper from two sides of the box.
Figure 6A:
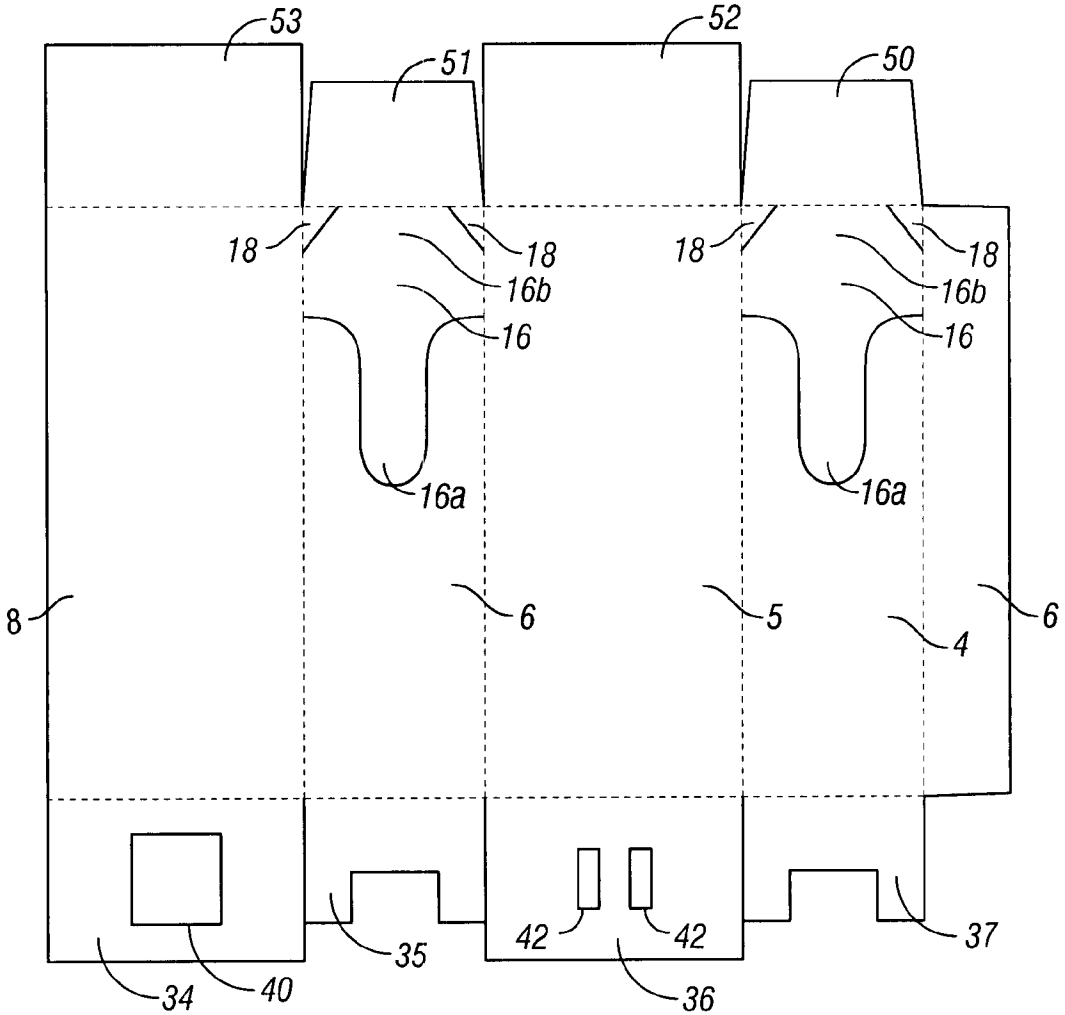
FIG. 6*a* is a top view of the box die cut pattern for dispenser of FIG. 6.
Figure 7:
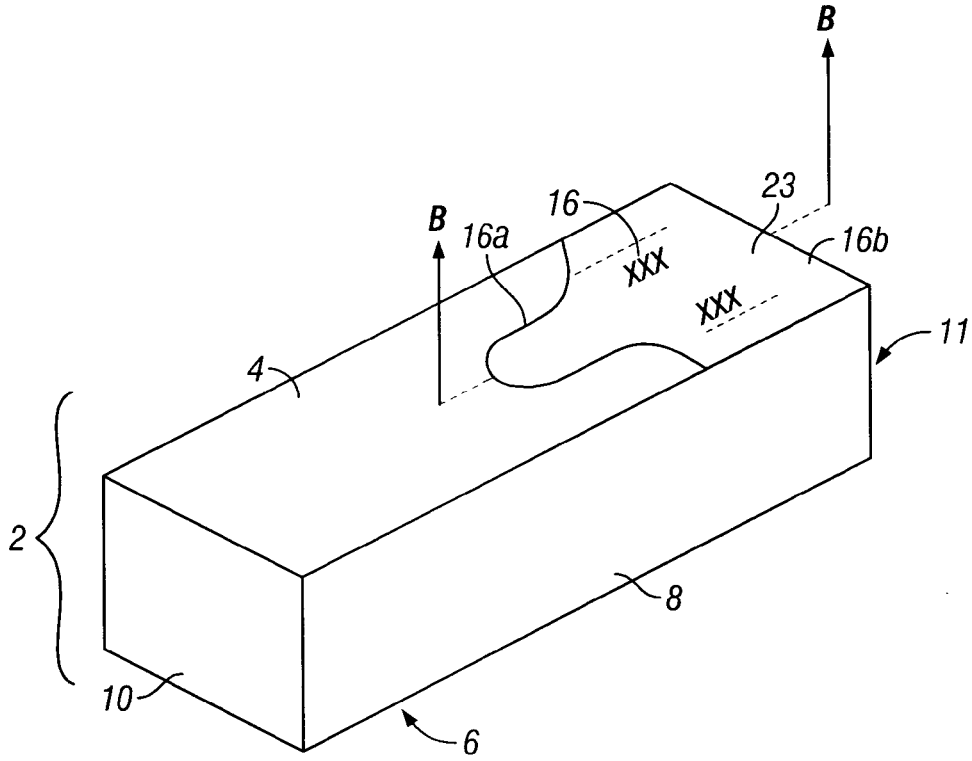
FIG. 7 is a perspective view of an example of one embodiment of a sample box of the present invention.
Figure 8:
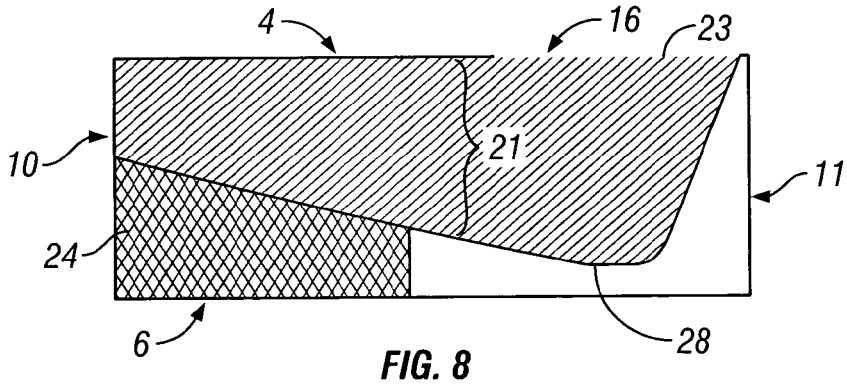
FIG. 8 is a cross section view, taken along the line B—B of FIG. 7.

Referring to FIGS. 6 and 6*a*, in an alternate embodiment, the dispenser 2 has two openings 16, so that flexible paper 20 can be removed from each of the walls 4, 6 of the dispenser 2. Preferably, these openings 16 are located on opposite walls of the dispenser 2, although they may also be on adjacent walls (or on opposed side walls 5, 8 or on side wall 5 or 8 and top wall 4 or bottom wall 6). In this embodiment, the top wall 4 and the bottom wall 6 of the dispenser each include an opening 16 sufficiently large to allow a person to remove the sheets of paper from the dispenser 2 with one or more fingers. These openings 16 may encompass approximately one-quarter to one-half of the top and bottom walls 4, 6; however, a portion 18 of each wall 4, 6 is retained at each of two corners of both openings 16 to hold the paper stack 20 within the dispenser 2, as discussed above.

When the openings 16 are located on adjacent walls, it will be recognized that an interior wall (not shown) can be used to separate stacks of paper 20 such that one stack of paper 20 can be removed from one of the openings 16 and the other stack of paper 20 can be removed from the other opening. Each stack, of course, would be supported by an insert 24 and preferably a piece of board stock 26, as described above.

The insert 24 described above, which may be a piece of foam and a folded piece of board stock 26, is then sandwiched between two stacks of paper 20 and inserted into the two-sided dispenser 2 such that about one-quarter to about one-half of the top sheet 22 on each stack is able to be grasped through one of the openings 16 in the dispenser 2. The corners of the top coupons 22 are held down by the portions 18 at the corners 15, 17 of the openings 16 on each side 4, 6 of the dispenser 2. This allows the sheets of paper 20 to be individually removed from the dispenser 2, while still being held entirely within the dispenser 2 prior to removal. As the top sheet 22 on either side stack 20 is withdrawn through the opening 16 in the dispenser 2, the next sheet in the stack 20 is exposed for removal. However, each sheet 22 is held entirely within the dispenser 2 by the corners 18 until it is withdrawn from the stack 20 by a consumer. The insert 24 sandwiched between the stacks of paper 20 within the dispenser 2 urges the paper stacks 20 toward each respective opening 16 and assists in the removal of the sheets 22 from the dispenser 2.

Figure 9:
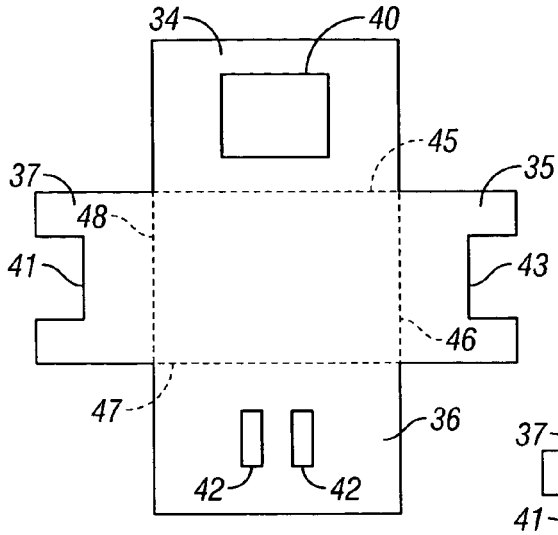
FIG. 9 is a top view of an example of one method of end flap construction to support attachment of the coupon or sample box of the present invention.
Figure 10:
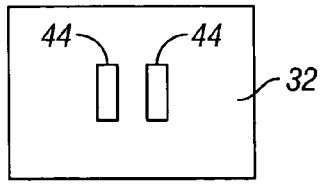
FIG. 10 is a top view of an example of a plastic strip which can be attached to a coupon or sample box to support the attachment means of the coupon or sample box.
Figure 12:
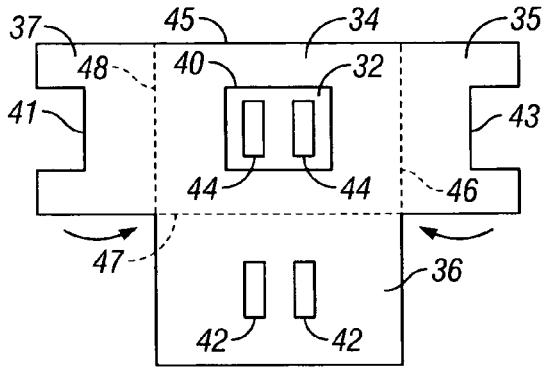
FIGS. 12–14 show a view of one method of folding the end flaps of one embodiment of the present invention as described in FIG. 9.
Figure 11:
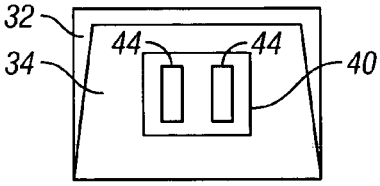
FIG. 11 is a perspective view of an example of a plastic strip such as that described in FIG. 10 adhered to one of the end flaps of the coupon or sample box which work together to support the attachment means of the coupon or sample box.
Figure 13:
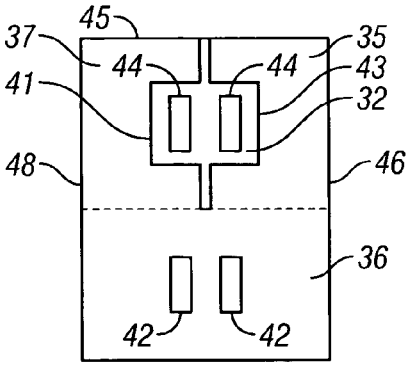
Figure 14:
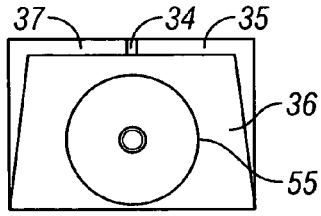
Figure 15:
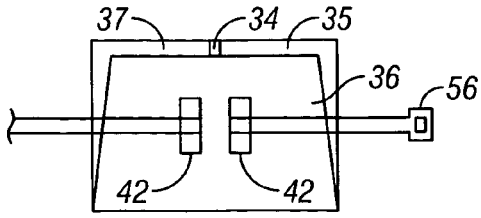
FIG. 15 shows a view of one end of an embodiment of the present invention, with the end flaps folded and a cable tie inserted.

Referring to FIGS. 5, 6*a*, 7–8, an alternative embodiment of the dispenser 2 for dispensing product samples preferably comprises a rectangular-shaped box that is made from a single piece of board stock folded in a manner to create the dispenser 2, although as noted previously, other shapes are equally applicable to the present invention. Methods of folding the single piece of board stock are well-known in the art, and result in a dispenser 2 having four walls (top wall 4, bottom wall 6, and two side walls 5, 8) and two ends 10, 11. Each of the ends of the dispenser include extensions, or end flaps 34, 35, 36, 37 and 50, 51, 52, 53 (see FIGS. 6*a*, 9), of the walls folded together to form the ends 10, 11 of the dispenser 2. The top wall 4 of the dispenser 2 includes an opening 16 sufficiently large to allow a person to remove a product sample packet 23 from the dispenser 2 with, for example one or two fingers or the thumb and a finger. This opening 16 may encompass approximately one-quarter to one-half of the top wall 4. In this embodiment, there may or may not be a portion 18 of the top wall retained at each of two corners of the opening 16 of the dispenser 2. A stack of product sample packets 21 is placed within the dispenser 2 such that about one-quarter to one-half of the top packet 23 on the stack 21 is able to be grasped through the opening 16 in the dispenser. As the top packet 23 on the stack 21 is withdrawn through the opening 16 in the dispenser 2, the next packet in the stack 21 is exposed for removal. However, each packet 23 is held entirely within the dispenser 2 until it is withdrawn from the stack 21 by a consumer.

In order to urge the stack of packets 21 toward the opening 16 in the dispenser 2, the dispenser 2 is provided with an insert 24, preferably of foam or other resilient materials, as noted previously. The insert 24 is preferably positioned underneath a ramp structure 28, preferably made of plastic or other similar material, but can also be used without such ramp structure. The ramp structure has an end piece 30 which is folded between the end flaps 51, 52, 53, 54 of the dispenser 2, and secured therein by a pressure sensitive adhesive. When located beneath the stack of packets 21 within the dispenser 2, which rest on the ramp 28, the resilient block 24 provides a spring-like action gently pushing the packet 21 towards the dispenser opening 16 for individual packet removal by the customer.

Finally, there are various ways to attach the proposed dispenser 2 to a desired surface (e.g., shelves or windows in a store), including the use of cable ties 56 or suction cups 55. Referring to FIGS. 9–15, in one embodiment, the end flaps 34, 35, 36, 37 on one end 10 of the dispenser 2 contain cut-out portion(s) 40, 41, 42, 43 which allow the base of a suction cup(s) 55, cable ties 56, or other attachment means, to be secured inside the dispenser 2 while the suction cup(s) 55 protrudes through the cut-out portion(s) 40, 41, 42, 43 where it is available as a means of attaching the dispenser 2 to a glass or similar surface by suction, for example, on a refrigeration unit at a grocery store.

A support piece 32, made from hard plastic or other similarly sturdy material, with at least one cut-out portion 44, is attached by a pressure sensitive adhesive to one of the end flaps 34 of the dispenser 2 on the end 10 that is to be secured to the desired surface. The end flaps 34, 35, 36, 37 contain cut-out portions 40, 41, 42, 43 shaped so that when the end flaps 34, 35, 36, 37 are folded together at creases 45, 46, 47, 48 and secured with a pressure sensitive adhesive to form the end 10, all the cut-out portions align so as to allow a suction cup(s) 55, or other attachment means, to protrude through the dispenser 2 while the base of such suction cup(s) 55 is secured inside the dispenser 2. The support piece 32 acts to reinforce the end 10 so that the suction cup(s) 55 is able to support the entire dispenser 2 when suspended from the desired surface.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A dispenser of items from a stack which permits the items to be dispensed one at a time, comprising:

a container having a wall, said wall having an opening therein to expose at least a portion of at least one of said items to be dispensed from said container;

said wall having at least one retaining member located adjacent to said opening, wherein said retaining member covers a portion of at least one of said items within said container; and an insert positioned within said container, said insert comprising a resilient member proximate to a last item in the stack, wherein said resilient member urges said items towards said opening, wherein said insert includes a contacting surface formed of board stock and said resilient member comprises foam, and wherein said contacting surface is integral with said resilient member.

2. A dispenser of items from a stack which permits the items to be dispensed one at a time, comprising:

a container having a first wall, said first wall having an opening therein to expose at least a portion of one of said items to be dispensed from said container;

at least one other wall having an opening therein to expose at least a portion of one of said items to be dispensed from said container;

said first wall and said at least one other wall each having at least one retaining member located adjacent to said openings wherein said retaining members cover a portion of one of said items within said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, wherein said items comprise individual product sample packets housed within said dispenser.

3. A dispenser of items from a stack which permits the items to be dispensed one at a time, comprising:

a container having a first wall, said first wall having an opening therein to expose at least a portion of one of said items to be dispensed from said container;

at least one other wall having an opening therein to expose at least a portion of one of said items to be dispensed from said container;

said first wall and said at least one other wall each having at least one retaining member located adjacent to said openings wherein said retaining members cover a portion of one of said items within said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, wherein said contacting surface is integral with said resilient member.

4. A dispenser of items from a stack which permits the items to be dispensed one at a time, comprising:

a container having a first wall, said first wall having an opening therein to expose at least a portion of one of said items to be dispensed from said container;

at least one other wall having an opening therein to expose at least a portion of one of said items to be dispensed from said container;

said first wall and said at least one other wall each having at least one retaining member located adjacent to said openings wherein said retaining members cover a portion of one of said items within said container; and an insert positioned within said container, said insert comprising at least one resilient member and at least one contacting surface, said at least one resilient member being located beneath said at least one contacting surface wherein said at least one resilient member and said at least one contacting surface urge said items towards said openings; and at least one support piece, said support piece having at least one cutout portion, with said support piece attached to at least one wall of said dispenser.

5. A dispenser of items from a stack which permits the items to be dispensed one at a time, comprising:

a container having a first wall, said first wall having an opening therein to expose at least a portion of one of said items to be dispensed from said container;

at least one other wall having an opening therein to expose at least a portion of one of said items to be dispensed from said container;

said first wall and said at least one other wall each having at least one retaining member located adjacent to said openings wherein said retaining members cover a portion of one of said items within said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, including at least one cable tie coupled to the dispenser to allow the dispenser to be attached to a support structure.

6. A dispenser of items from at least one stack which permits the items to be dispensed one at a time, comprising:

a container having a first wall, said first wall having an opening therein to expose at least a portion of one of said items to be dispensed from said container;

at least one other wall having an opening therein to expose at least a portion of one of said items to be dispensed from said container;

said first wall and said at least one other wall each having at least one retaining member located adjacent to said openings wherein said retaining members cover a portion of one of said items within said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, wherein said contacting surface is formed of board stock approximately twice the length of the dispenser and said resilient member is a piece of foam shaped generally as a rectangular block, wherein said contacting surface is folded approximately in half around said resilient member and said items comprise individual sheets of flexible paper housed within said dispenser and at least one stack of said sheets is placed on the sides of said folded contacting surface, allowing the resilient member to exert pressure on said at least one stack simultaneously, urging said items towards their respective openings.

7. A dispenser of items from a stack which permits the items to be dispensed one at a time, comprising:

a container having a wall, said wall having an opening therein to expose at least a portion of one of said items to be dispensed from said dispenser; and an insert positioned within said container, said insert comprising a resilient member proximate to a last item in the stack, wherein said resilient member urges said items towards said opening, wherein said insert further comprises a contacting surface, wherein said contacting surface comprises a plastic ramp and said resilient member comprises foam and is shaped and positioned to be compressed under said contacting surface, wherein said contacting surface length is greater than the length of the dispenser and said contacting surface is fixed in place by folding the additional contacting surface length over one end of the dispenser and securing it to at least one wall of the dispenser.

8. A dispenser of items from a stack which permits the items to be dispensed one at a time, comprising:

a container having a wall, said wall having an opening therein to expose at least a portion of one of said items to be dispensed from said dispenser; and an insert positioned within said container, said insert comprising a resilient member proximate to a last item in the stack, wherein said resilient member urges said items towards said opening, wherein said insert further comprises a contacting surface, wherein said contacting surface comprises a plastic ramp and said resilient member comprises foam and is shaped and positioned to be compressed under said contacting surface, wherein said contacting surface is integral with said resilient member.

9. A dispenser of individual items from a stack which permits the items to be dispensed one at a time, comprising:

a container having a wall, said wall having an opening therein to expose at least a portion of one of said items to be dispensed from said dispenser;

at least one other wall having an opening therein to expose at least a portion of one of said items to be dispensed from said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, wherein said contacting surface consists of a plastic ramp and said resilient member is made of foam and is shaped and positioned to be compressed under said contacting surface.

10. A dispenser of individual items from a stack which permits the items to be dispensed one at a time, comprising:

a container having a wall, said wall having an opening therein to expose at least a portion of one of said items to be dispensed from said dispenser;

at least one other wall having an opening therein to expose at least a portion of one of said items to be dispensed from said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, wherein said contacting surface length is greater than the length of the dispenser and said contacting surface is fixed in place by folding the additional contacting surface length over one end of the dispenser and securing it to at least one wall of the dispenser.

11. A dispenser of individual items from a stack which permits the items to be dispensed one at a time, comprising:

a container having a wall, said wall having an opening therein to expose at least a portion of one of said items to be dispensed from said dispenser;

at least one other wall having an opening therein to expose at least a portion of one of said items to be dispensed from said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, wherein said contacting surface is integral with said resilient member.

12. A dispenser of individual items from a stack which permits the items to be dispensed one at a time, comprising:

a container having a wall, said wall having an opening therein to expose at least a portion of one of said items to be dispensed from said dispenser;

at least one other wall having an opening therein to expose at least a portion of one of said items to be dispensed from said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, including a support piece having at least one cutout portion and attached to at least one wall of the dispenser.

13. A dispenser of individual items from a stack which permits the items to be dispensed one at a time, comprising:

a container having a wall, said wall having an opening therein to expose at least a portion of one of said items to be dispensed from said dispenser;

at least one other wall having an opening therein to expose at least a portion of one of said items to be dispensed from said container; and an insert positioned within said container, said insert comprising at least one resilient member and at least one contacting surface, said at least one resilient member being located beneath said at least one contacting surface wherein said at least one resilient member and said at least one contacting surface urge said items towards said openings, wherein said openings are in opposing walls.

* * * * *

UNITED STATES PATENT AND TRADEMARK OFFICE

CERTIFICATE OF CORRECTION

PATENT NO. : 7,000,802 B2
DATED : February 21, 2006
INVENTOR(S) : George Kringel et al.

It is certified that error appears in the above-identified patent and that said Letters Patent is hereby corrected as shown below:

Title page,
Item [73], Assignee, substitute -- News America Marketing Properties, Inc., Chicago, IL (US) -- for "News America Marketing, Wilton, CT (US)".

Signed and Sealed this

Thirteenth Day of June, 2006

JON W. DUDAS
*Director of the United States Patent and Trademark Office*